US009854882B1

(12) United States Patent
Peck

(10) Patent No.: US 9,854,882 B1
(45) Date of Patent: Jan. 2, 2018

(54) CANE WALKING SUPPORT APPARATUS CONFIGURED TO TRANSFORM INTO A CHAIR

(71) Applicant: Maria Peck, San Diego, CA (US)

(72) Inventor: Maria Peck, San Diego, CA (US)

( * ) Notice: Subject to any disclaimer, the term of this patent is extended or adjusted under 35 U.S.C. 154(b) by 0 days.

(21) Appl. No.: 15/623,319

(22) Filed: Jun. 14, 2017

(51) Int. Cl.

| | |
|---|---|
| ***A45B 5/00*** | (2006.01) |
| ***A45B 3/00*** | (2006.01) |
| ***A47C 13/00*** | (2006.01) |
| *A45B 9/00* | (2006.01) |

(52) U.S. Cl.
CPC ..... *A45B 5/00* (2013.01); *A45B 3/00* (2013.01); *A47C 13/00* (2013.01); *A45B 2009/007* (2013.01)

(58) Field of Classification Search
CPC ..... A45B 5/00
See application file for complete search history.

(56) References Cited

U.S. PATENT DOCUMENTS 617,661 A * 1/1899 Smith ..... A45B 5/00 297/118
651,360 A * 6/1900 Kapp ..... A45B 5/00 248/155.5
723,382 A * 3/1903 Halin ..... A45B 5/00 135/66
757,776 A * 4/1904 Russell ..... A45B 5/00 248/155.4
980,159 A * 12/1910 Kapp ..... A45B 5/00 248/155.4
984,292 A * 2/1911 Paris ..... A45B 5/00 248/155.4
1,187,297 A * 6/1916 Franke ..... A45B 5/00 248/155.4
1,545,054 A * 7/1925 Leister ..... A45B 5/00 248/155.4
2,742,956 A * 4/1956 Cannata ..... A45B 3/00 135/66
2,766,813 A 10/1956 Kay
2,798,536 A * 7/1957 Shew ..... A45B 5/00 108/115
3,537,748 A 11/1970 Knapp
4,700,730 A 10/1987 Samuelson et al.
4,729,395 A 3/1988 Adamson et al.
5,275,187 A 1/1994 Davis
5,380,262 A 1/1995 Austin
(Continued)

*Primary Examiner* — David R Dunn
*Assistant Examiner* — Danielle Jackson
(74) *Attorney, Agent, or Firm* — ARC IP Law, PC; Joseph J. Mayo

(57) ABSTRACT

A device that can be configured as a walking aid, such as one or more canes, or as a chair for sitting. In the walking aid configuration, the device may include two canes. Each cane may have a main leg and a secondary leg that may be rotated parallel to the main leg to form a cane, or rotated away from the main leg to form one half of a chair support. One of the canes may include a seat crossbar that folds out and extends between the two chair supports formed from the two canes. Handles may be attached or integrated into the main legs. Because the chair configuration may be formed from only five linear members (two main legs, two secondary legs, and the seat crossbar), the canes may be compact and lightweight when folded up into the walking aid configuration.

11 Claims, 6 Drawing Sheets

(56) References Cited

U.S. PATENT DOCUMENTS

| | | | | |
|---|---|---|---|---|
| 5,785,070 | A | 7/1998 | Block et al. | |
| 6,192,908 | B1 | 2/2001 | Smith | |
| 6,899,388 | B1 * | 5/2005 | Enrique | A47C 7/66 297/129 |
| 8,876,203 | B1 | 11/2014 | Haertl et al. | |
| 8,985,599 | B2 | 3/2015 | Peterson | |
| 9,089,194 | B2 | 7/2015 | Tessier | |
| 9,179,746 | B2 * | 11/2015 | Gullo | A45B 5/00 |
| 9,180,064 | B2 | 11/2015 | Prather | |
| 2010/0031985 | A1 * | 2/2010 | Decesari | A45B 5/00 135/66 |
| 2010/0163087 | A1 | 7/2010 | Catton | |
| 2014/0034097 | A1 | 2/2014 | Pao | |
| 2014/0034098 | A1 | 2/2014 | Pao | |
| 2015/0107636 | A1 | 4/2015 | Pao | |

* cited by examiner

CANE WALKING SUPPORT APPARATUS CONFIGURED TO TRANSFORM INTO A CHAIR

BACKGROUND OF THE INVENTION

Field of the Invention

One or more embodiments of the invention are related to the field of walking aid devices. More particularly, but not by way of limitation, one or more embodiments of the invention enable a cane walking support apparatus that is configured to transform into a chair.

Description of the Related Art

Devices that combine walking support functions and seating capabilities are known in the art. For example, United States Patent Application Publication US2010/0163087 A1 teaches a walker that has a seat between the four legs of the walker; the seat can be folded up to allow the user to walk, or folded down to form a chair. United States Patent Application Publication US2014/0034098 A1 teaches a walking stick chair that has a seating surface and several legs than can be folded up to form a walking stick, but the folded configuration may be potentially bulky.

The devices known in the art include a seat or similar structure. Several of these devices are complex and are potentially bulky, heavy, and expensive. While some of the devices can be folded or collapsed when not used as a seat, the folded configuration is not minimal and does not resemble a standard cane. There are no known devices that use a minimal structure with a simple crossbar to form a seat between two canes, and that fold into compact canes when not used for sitting.

For at least the limitations described above there is a need for a cane walking support apparatus configured to transform into a chair.

BRIEF SUMMARY OF THE INVENTION

One or more embodiments described in the specification are related to a cane walking support apparatus configured to transform into a chair. Embodiments of the invention can be configured in a cane configuration for use as a walking aid, and in a chair configuration for sitting. In the cane configuration, one or more embodiments may fold for example into two separate canes, each of which may be simple and streamlined with a simple vertical shape.

One or more embodiments of the invention may have four support legs—two left support legs and two right support legs—and a seat support bar that may extend between the left and right sides. The two left support legs may be connected via a left support leg joint that allows these legs to rotate with respect to one another. Similarly, the two right support legs may be connected via a right support leg joint that allows these legs to rotate with respect to one another. The seat support bar may be connected to one of the support legs via a seat support joint, which allows the seat support bar to rotate with respect to the connected support leg. The seat support bar may be coupled to the support side opposite the seat support joint by a coupler.

In one or more embodiments, the apparatus may be transformed between a chair configuration and a cane configuration. Transforming into the cane configuration may include, for example, without limitation, rotating the seat support bar and the leg to which it is connected via the seat support joint until they are parallel; rotating the two left support legs around the left support leg joint until they are parallel; and rotating the two right support legs around the right support leg joint until they are parallel.

In one or more embodiments, the top of one of the left support legs may have an ergonomic handle. In one or more embodiments, the top of one of the right support legs may have an ergonomic handle. In one or more embodiments, the bottom of one or more support legs may have a non-slip surface. In one or more embodiments, one or more of the support legs may be adjustable in height.

One or more embodiments may include one or more support hinges or other support members coupled to the seat support bar or to any of the support legs.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A cane walking support apparatus configured to transform into a chair will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
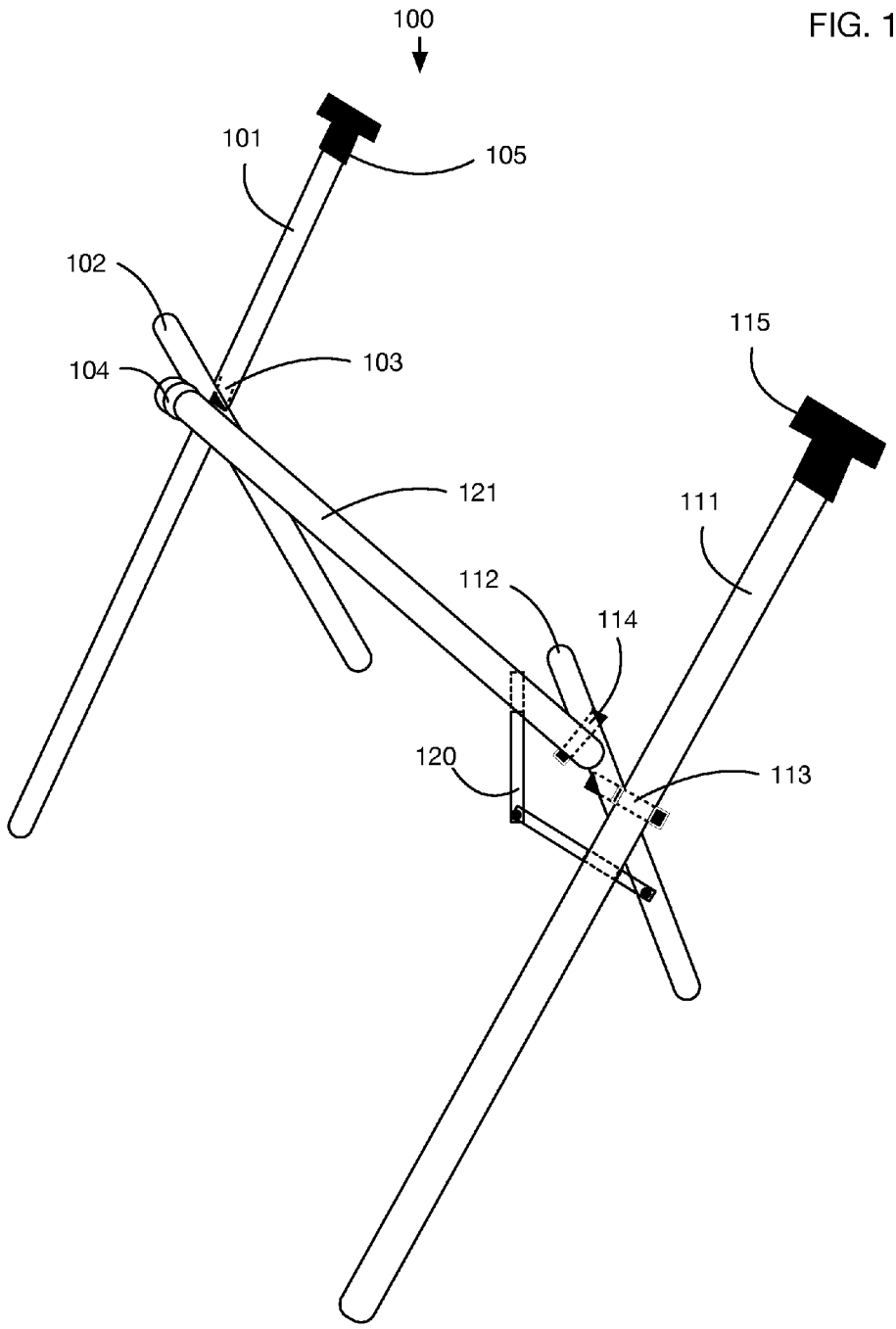
FIG. 1 shows an embodiment of the invention configured as a seat, with a crossbar between two cane elements that are folded out to form left and right seat supports.

FIG. 1 shows an embodiment 100 of the invention, shown in a chair configuration. Seat support crossbar 121 is extended between a left support side and a right support side. Each of the two support sides may fold into a cane configuration, as described below. The right support includes two support legs 101 and 102 connected by a joint 103 around which the legs can pivot. Similarly, the left support includes two support legs 111 and 112 connected by a joint 113 around which the legs can pivot. In FIG. 1, legs 101 and 102 are shown pivoted away from one another to form the right support for the chair, and legs 111 and 112 are shown pivoted away from one another to form the left support for the chair. Seat support crossbar 121 is connected to left leg 112 by joint 114. In one or more embodiments, the seat support crossbar 121 may be connected to a right leg by a joint instead of to a left leg. To form the chair configuration, seat support crossbar 121 may be rotated around joint 114 until it is approximately horizontal, and it may then be coupled to one or both of the right support legs. Embodiments may use any desired type of coupler or coupling to attach the seat crossbar to the right support. In the embodiment shown in FIG. 1, seat crossbar 121 is inserted into coupler 104, which may for example be a simple cylindrical receiver into which the crossbar is inserted. One or more embodiments may use any other types of couplers between the seat crossbar 121 and the right legs 101 or 102, such as for example, without limitation, pins, latches, bolts, screws, Velcro, ties, snaps, hooks, dowels, press fits, or any combinations thereof.

In the embodiment shown in FIG. 1, right leg 101 and left leg 111 have top handles 105 and 115, respectively. These handles may for example facilitate use of the invention as canes or other walking aids. The shape of handles 105 and 115 is illustrative; one or more embodiments may have handles of any desired size, shape, texture, and material. In one or more embodiments, the handle or handles may be ergonomic. In one or more embodiments, a left handle may have a different size, shape, texture, or material from a right handle. In one or more embodiments, the handle or handles may be integrated into the legs 101 and 111. In one or more embodiments, the handle or handles may be detachable or interchangeable. In one or more embodiments, the right or left legs may be adjustable in height, for example via a telescoping mechanism or by installation or removal of extensions; these adjustments may be used for example to adjust the height of the seat in the sitting configuration, or to adjust the height of the walking aids in the cane configuration. In one or more embodiments, the seat crossbar may be adjustable in length, width, diameter, or any other dimension. In one or more embodiments, the bottoms of any or all of legs 101, 102, 111, and 112 may made of a non-slip surface. In one or more embodiments, the bottoms of any or all of these legs may have attached feet that provide for example, without limitation, additional stability, shock absorption, non-slip surfaces, rolling, wheels, or any other capabilities.

The embodiment illustrated in FIG. 1 has a single seat crossbar 121. In one or more embodiments, there may be two or more seat crossbars, any or all of which may pivot with respect to one of the support legs and may be coupled in any manner to an opposite support leg. Similarly, the embodiment illustrated in FIG. 1 has two support legs on each side; in one or more embodiments, there may be three or more support legs on one or both sides.

One or more embodiments may include one or more support elements that may for example connect the seat crossbar to one of the support legs. The embodiment shown in FIG. 1 has a folding hinge support 120 that is connected to seat crossbar 121 and to support leg 112. The support 120 is shown partially folded for illustration; typically, this support may be fully extended and locked into position when the device is fully deployed in the chair configuration.

Figure 2:
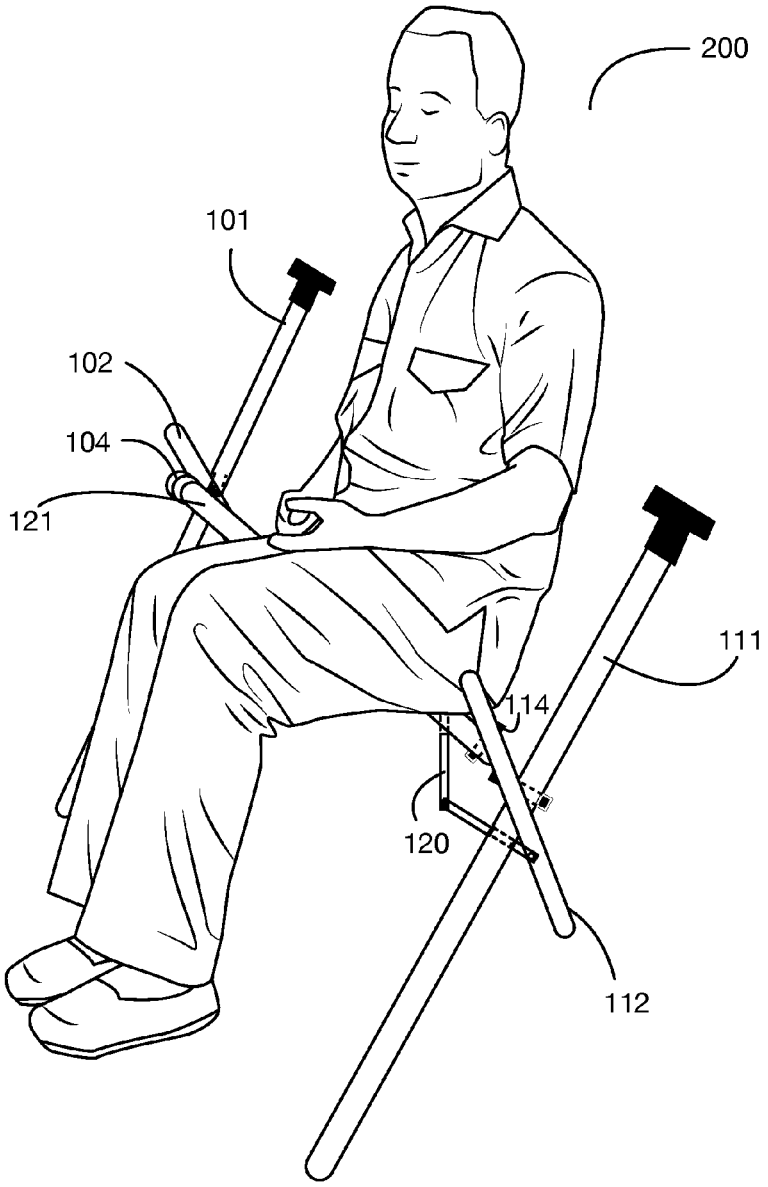
FIG. 2 illustrates a user using the seat configuration of FIG. 1 as a chair.

FIG. 2 shows an example of using the embodiment of FIG. 1 in the chair configuration for sitting. User 200 sits on the device, specifically on seat crossbar 121. The bottoms of support legs 101, 102, 111, and 112 rest on the ground or on another surface. The weight of user 200 is supported by the seat crossbar 121, and is transmitted to the support legs via joint 114 and via coupler 104, and potentially also by other supports such as folding hinge support element 120.

Figure 3:
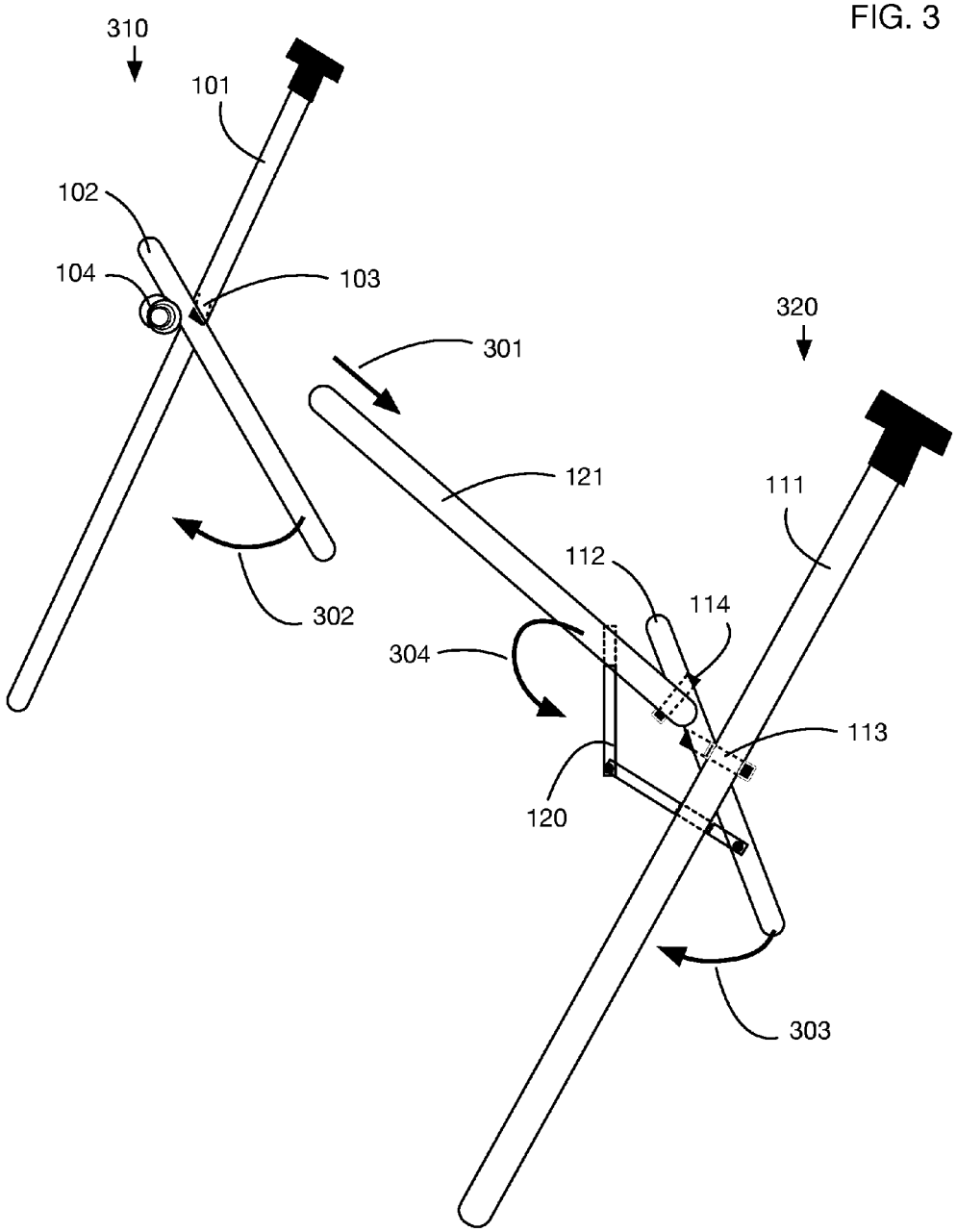
FIG. 3 shows how the seat configuration of FIG. 1 may be transformed into a cane configuration.

FIG. 3 illustrates transforming the embodiment of FIG. 1 from the chair configuration to a cane configuration. Seat crossbar 121 is moved in direction 301 out of coupler 104, thereby separating the left side of the device 320 and the right side 310. Each of the two sides 310 and 320 are then folded into a cane configuration. Specifically support leg 102 is rotated 302 around joint 103 until it is effectively parallel with leg 101. Seat crossbar 121 is rotated 304 around joint 114, and folding hinge support element 120 is collapsed. Then support leg 112 is rotated 303 around joint 113 until it is effectively parallel with support leg 111. These motions are illustrative; in one or more embodiments, other motions or other sequences may be used to transform the chair configuration into one or more cane configurations.

Figure 4:
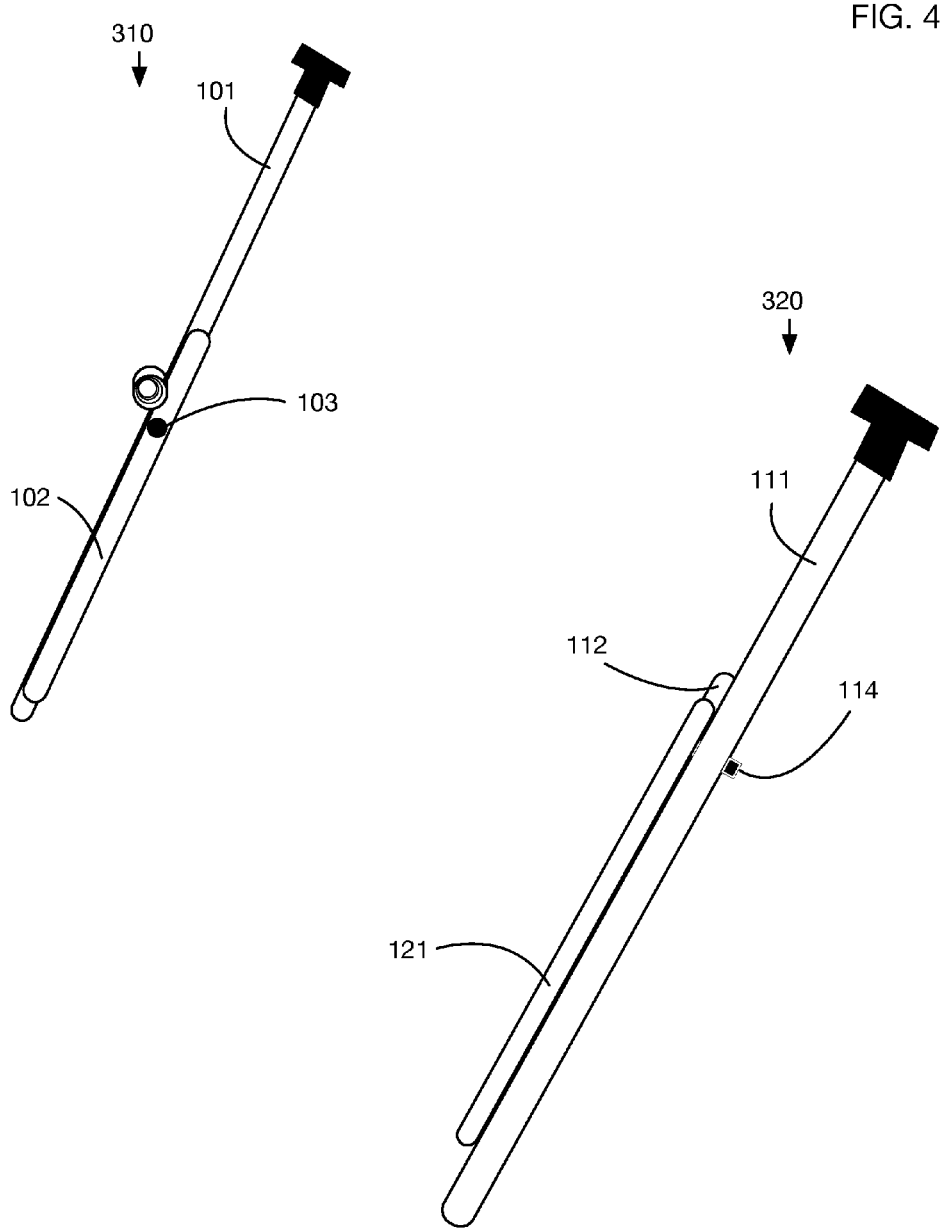
FIG. 4 shows the folded-up cane configuration of the embodiment of FIG. 1.
Figure 5:
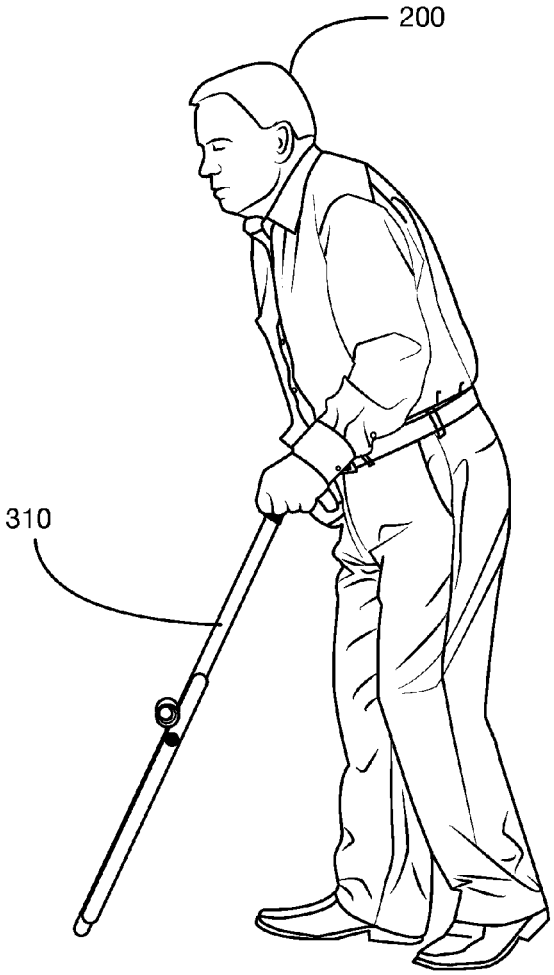
FIG. 5 illustrates a user using the cane configuration of FIG. 4 as a walking aid.

FIG. 4 shows the components 310 and 320 in the folded-up cane configurations after the transformations described above. In cane configuration 310, legs 101 and 102 are effectively parallel. In cane configuration 320, legs 111 and 112 and seat support crossbar 121 are effectively parallel. FIG. 5 illustrates user 200 using the cane configuration 310 as a walking assistance device. Cane configuration 320 may similarly be used as a walking assistance device, either by user 200 or by a different user.

Figure 6:
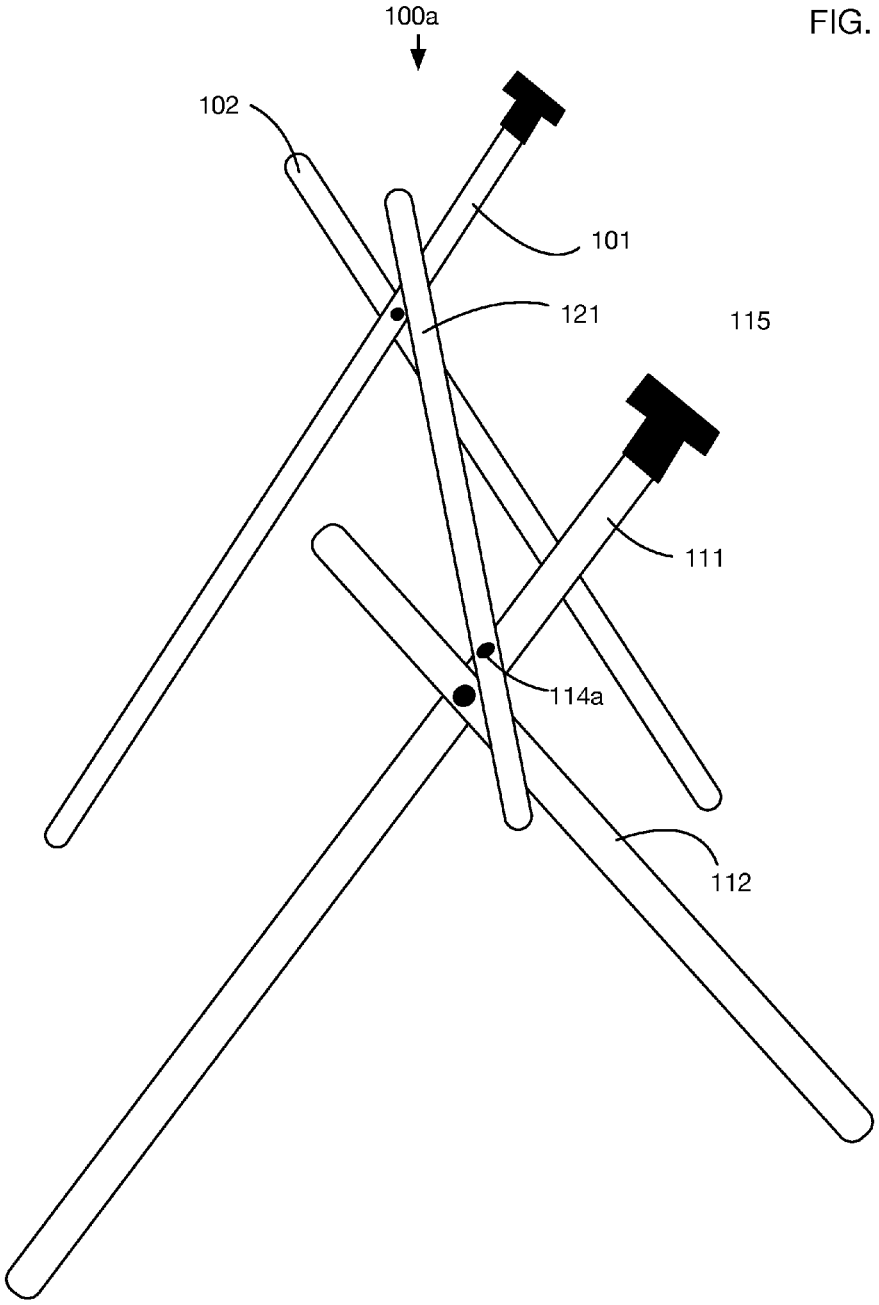
FIG. 6 illustrates a variation of the embodiment of FIG. 1, where the crossbar member between the sides rests in the V-shaped areas formed by the folded-out cane elements.

FIG. 6 illustrates another embodiment 100*a* of the apparatus, shown in a chair configuration. In this embodiment, the seat support crossbar 121 is coupled to the right support legs by resting in the V-shaped area formed between the top portions of legs 101 and 102. The seat support crossbar 121 is connected to left support leg 111 via joint 114*a*, around which the support leg pivots to transform between the seat configuration shown in FIG. 6 and a folded-up cane configuration.

While the invention herein disclosed has been described by means of specific embodiments and applications thereof, numerous modifications and variations could be made thereto by those skilled in the art without departing from the scope of the invention set forth in the claims.

What is claimed is:

1. A cane walking support apparatus configured to transform into a chair comprising:

a first left support leg with a top portion and a bottom portion;

a first right support leg with a top portion and a bottom portion;

a second left support leg with a top portion and a bottom portion;

a second right support leg with a top portion and a bottom portion;

a seat support bar;

a left support leg joint, wherein the left support leg joint is configured to rotatably couple the first left support leg to the second left support leg;

a right support leg joint, wherein the right support leg joint is configured to rotatably couple the first right support leg to the second right support leg;

a seat support joint, wherein the seat support joint is coupled to the top portion of the second left support leg, and, wherein the seat support bar is rotatably coupled to the second left support leg by the seat support joint;

a coupler, wherein the coupler is coupled to the top portion of the second right support leg, and, wherein the coupler is configured to couple the seat support bar to the second right support leg; and, a folding hinge support that is connected to the seat support bar and to the first left support leg, wherein said folding hinge support is configured to transform from a partially folded position to a fully extended position, and wherein said folding hinge support comprises a first end coupled to said seat support bar and a second end coupled to said first left support leg;

wherein said first left support leg, said second left support leg, said first right support leg, said second right support leg, said seat support bar, said left support leg joint, said right support leg joint, said seat support joint, said coupler and said folding hinge support are configured to transform between a chair configuration and two canes configuration, wherein to transform to said two canes configuration said seat support bar is configured to move out of said coupler to separate said first left support leg and said second left support leg from said first right support leg and said second right support leg, said second right support leg is configured to rotate into a parallel orientation with respect to said first right support leg, and said seat support bar is further configured to rotate around said seat support joint, said folding hinge support is further configured to collapse and said second left support leg is configured to rotate around said left support leg joint until said second left support leg is in a parallel orientation with respect to said first left support leg such that said seat support bar, said first left support leg and said second left support leg are in a parallel orientation with respect to one another.

2. The cane walking support apparatus configured to transform into a chair of claim 1, wherein the top portions of the first left support leg and the first right support leg comprise an ergonomic handle.

3. The cane walking support apparatus configured to transform into a chair of claim 1, wherein the top portions of the first left support leg and the first right support leg are configured to adjust in height.

4. The cane walking support apparatus configured to transform into a chair of claim 1, wherein the bottom portions of the first left support leg, the first right support leg, the second left support leg, and the second right support leg comprise a non-slip surface.

5. The cane walking support apparatus configured to transform into a chair of claim 1, wherein the bottom portions of the first left support leg, the first right support leg, the second left support leg, and the second right support leg are configured to adjust in height.

6. The cane walking support apparatus configured to transform into a chair of claim 1, wherein the coupler is coupled to the top portion of the second right support leg on an outside surface of said second right support leg and wherein said coupler is a separate element than said second right support leg.

7. The cane walking support apparatus configured to transform into a chair of claim 1, wherein the seat support bar is configured to adjust in length.

8. A cane walking support apparatus configured to transform into a chair comprising:

a first left support leg with a top portion and a bottom portion;

a first right support leg with a top portion and a bottom portion;

a second left support leg with a top portion and a bottom portion;

a second right support leg with a top portion and a bottom portion;

a seat support bar;

a left support leg joint, wherein the left support leg joint is configured to rotatably couple the first left support leg to the second left support leg;

a right support leg joint, wherein the right support leg joint is configured to rotatably couple the first right support leg to the second right support leg;

a seat support joint, wherein the seat support joint is coupled to the top portion of the second left support leg, and, wherein the seat support bar is rotatably coupled to the second left support leg by the seat support joint;

a coupler, wherein the coupler is coupled to the top portion of the second right support leg, and, wherein the coupler is configured to couple the seat support bar to the second right support leg; and, at least one folding hinge support, wherein the at least one folding hinge support is connected to the seat support bar and to the first left support leg to couple the seat support bar to the first left support leg, wherein said at least one folding hinge support is configured to transform from a partially folded position to a fully extended position, wherein said at least one folding hinge support comprises a first end coupled to said seat support bar and a second end coupled to said first left support leg;

wherein said coupler is coupled to the top portion of the second right support leg on an outside surface of said second right support leg and wherein said coupler is a separate element than said second right support leg, wherein the seat support bar is configured to adjust in length, wherein said first left support leg, said second left support leg, said first right support leg, said second right support leg, said seat support bar, said left support leg joint, said right support leg joint, said seat support joint, said coupler and said at least one folding hinge support are configured to transform between a chair configuration and two canes configuration, wherein to transform to said two canes configuration said seat support bar is configured to move out of said coupler to separate said first left support leg and said second left support leg from said first right support leg and said second right support leg, said second right support leg is configured to rotate into a parallel orientation with respect to said first right support leg, and said seat support bar is further configured to rotate around said seat support joint, said at least one folding hinge support is further configured to collapse and said second left support leg is configured to rotate around said left support leg joint until said second left support leg is in a parallel orientation with respect to said first left support leg such that said seat support bar, said first left support leg and said second left support leg are in a parallel orientation with respect to one another.

9. The cane walking support apparatus configured to transform into a chair of claim 8, wherein the top portions of the first left support leg and the first right support leg comprise an ergonomic handle.

10. The cane walking support apparatus configured to transform into a chair of claim 9, wherein the height of the top portions of the first left support leg and the first right support leg are configured to adjust in height.

11. The cane walking support apparatus configured to transform into a chair of claim 8, wherein the bottom portions of the first left support leg, first right support leg, second left support leg, and second right support leg comprise a non-slip surface.

* * * * *